United States Patent [19]

Kelley

[11] Patent Number: 4,791,849

[45] Date of Patent: Dec. 20, 1988

[54] MOTORIZED STRING TUNING APPARATUS

[76] Inventor: Rory R. Kelley, Box 182, Midkiff, Tex. 79755

[21] Appl. No.: 145,413

[22] Filed: Jan. 19, 1988

[51] Int. Cl.[4] ..... G10G 7/02

[52] U.S. Cl. ..... 84/458; 84/454

[58] Field of Search ..... 84/453, 454, 458, 459

[56] References Cited

U.S. PATENT DOCUMENTS

| | | | |
|---|---|---|---|
| 3,813,983 | 6/1974 | Paul | 84/454 X |
| 3,952,625 | 4/1976 | Peterson | 84/454 |
| 4,088,052 | 5/1978 | Hedrick | 84/454 |

*Primary Examiner*—Lawrence R. Franklin
*Attorney, Agent, or Firm*—Leon Gilden

[57] ABSTRACT

A motorized string tuning apparatus is set forth for the tuning of string instruments by the tensioning of the elongated filaments associated therewith. A portable motorized unit with an axially disposed shaft emanating therefrom rotatably engages and tightens the aforenoted string instruments for tuning purposes. Associated therewith are a plurality of illuminating lights for application in dimly lit environments and further including a counter means enabling a user to gauge the rotations of the device avoiding over-tightening of the aforenoted filaments.

4 Claims, 2 Drawing Sheets

MOTORIZED STRING TUNING APPARATUS

BACKGROUND OF THE INVENTION

1. Field of the Invention

The present invention relates to string tuning devices, and more particularly pertains to a new and improved motorized tuning apparatus of compact configuration including illumination means for visibility in typical dimly lit environments and counter means for avoiding over-torquing of strings associated with the instrument to be tuned.

2. Description of the Prior Art

The use of string tuning apparatus is well known in the prior art. As may be appreciated, these devices have normally been of manually manipulable levering apparatus where the proper orientation and manipulation of the device was essential in the rotation of the pegs to tension the associated musical strings. The effort require to tune such instruments, even with the association of manually manipulable devices, has required significant effort and in the case of elderly or feeble individuals, burdensome. The relative proximity of the various pegs about a mutual instrument has further complicated the tuning situation where many devices being of awkward construction resist application to the closely positioned tuning pegs. In this connection there have been several attempts to develop tuning apparatus which may be readily and effectively utilized in the tuning of musical instruments. For example, U.S. Pat. No. 8,813,988 to Paul sets forth a motorized tuning apparatus wherein an orthogonally projecting socket projects from a planar-like case arrangement. The Paul patent relies on a rather complicated clutching arrangement to limit torque application to a guitar peg and furthermore lacks an essential of the instant invention in the utilization of illumination means in association with the use of the apparatus as frequently musicians and the like utilizing such apparatus are required to tune their instruments in relatively dimly lit environments.

U.S. Pat. No. 8,706,254 to Morin sets forth a manually manipulable tuning tool comprising a crank-like handle offset from a socket to enable rotation of the socket to effect a prying and accordingly a tuning of the associated musical instrument. The Morin patent is not particularly well adapted for use in dimly lit environments nor does it contain any means for gauging the turning of the tuning pegs of the associated instrument.

U.S. Pat. No. 455,822 to Weber utilizes a plier-like apparatus for engaging the sounding post associated with string instruments to grasp and rotate same to effect tuning thereby. The cumbersome and crude manner of application of the Weber patent limits its application for those individuals of limited physical dexterity and clearly lacks any means for illumination, as is commonly necessary in a tuning environment.

U.S. Pat. No. 762,723 to Hutchins illustrates another plier-like device to grasp tuning pegs of a string instrument to rotate same. The plier-like device is awkwardly applied in rotating the typically closely positioned pegs of a guitar or the like and is of limited applicability.

U.S. Pat. No. 2,812,682 to Longone, et al. illustrates another crank-like device wherein a socket and an offset handle are relatively rotated for the tightening of a peg associated with a musical string. The deficiencies of the Longone patent is consistent with other devices of similar construction in the prior art.

As such, it may be appreciated that there is a continuing need for a new and improved tuning apparatus which addresses both the problem of effectiveness, portability, and utility in dimly lit environments, and in this respect the present invention substantially fulfills this need.

SUMMARY OF THE INVENTION

In view of the foregoing disadvantages inherent in the known types of string tuning apparatus now present in the prior art, the present invention provides a motorized string tuning apparatus wherein an elongate relatively rotatable motorized peg grasping socket includes illumination means and counter means for enhancing visibility and accuracy of the tuning process. As such, the general purpose of the present invention, which will be described subsequently in greater detail, is to provide a new and improved string tuning apparatus which has all the advantages of the prior art string tuning apparatus and none of the disadvantages.

To attain this, the present invention comprises a motorized string tuning apparatus utilizing a cylindrically elongate housing enabling ready grasping by a user thereof containing a motor of conventional construction actuable by a conveniently positioned switch mounted on the housing. An extensible elongate shaft, axially oriented to the elongate housing, includes a bifurcated socket arrangement for grasping of a tuning peg of a musical instrument with illumination means actuable upon engaging the aforenoted motor means. Included also is a counter for enabling a user to gauge the relative turns and thereby limit the chance of accidental breakage of an associated musical string.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorized string tuning apparatus which has all the advantages of the prior art motorized string tuning apparatus and none of the disadvantages.

It is another object of the present invention to provide a new and improved motorized string tuning apparatus which may be easily and efficiently manufactured and marketed.

It is a further object of the present invention to provide a new and improved motorized string tuning apparatus which is of a durable and reliable construction.

An even further object of the present invention is to provide a new and improved motorized string tuning apparatus which is susceptible of a low cost of manufacture with regard to both materials and labor, and which accordingly is then susceptible of low prices of sale to the consuming public. thereby making such motorized string tuning apparatus economically available to the buying public.

Still yet another object of the present invention is to provide a new and improved motorized string tuning apparatus which provides in the apparatuses and methods of the prior art some of the advantages thereof. While simultaneously overcoming some of the disadvantages normally associated therewith.

Still another object of the present invention is to provide a new and improved motorized string tuning apparatus wherein an axially elongate housing has extending therefrom an axial shaft supporting a bifurcated socket.

Yet another object of the present invention is to provide a new and improved motorized string tuning apparatus including illumination means for enhancing visibility in dimly lit tuning environments.

Even still another object of the present invention is to provide a new and improved motorized string tuning apparatus including a counter for enabling a user to gauge the relative number of turn applied to a musical instrument peg.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 3:
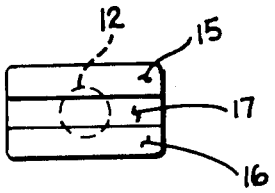
FIG. 3 is an orthographic side frontal view taken in elevation of the bifurcated socket of the present invention of FIG. 2.
Figure 4:
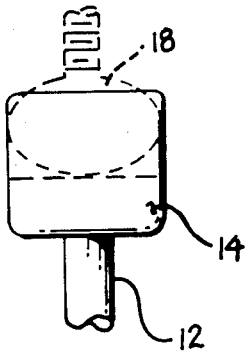
FIG. 4 is an orthographic top view of the bifurcated socket of the invention as applied to a peg associated with a musical instrument.
Figure 2:
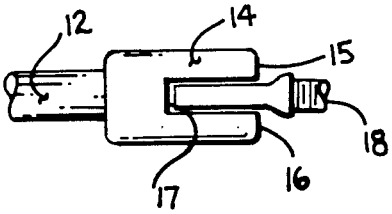
FIG. 2 is an orthographic view in elevation of the bifurcated socket of the present invention.
Figure 1:
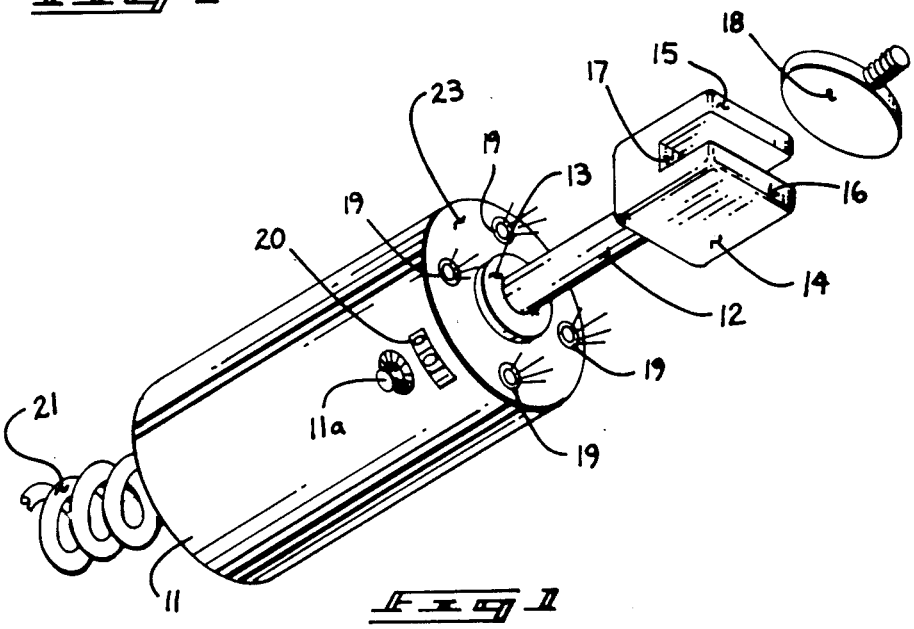
FIG. 1 is an isometric illustration of the present invention illustrating the various parts, their configuration and relationship.

With reference now to the drawings, and in particular to FIG. 1 thereof, a new and improved motorized string tuning apparatus embodying the principles and concepts of the present invention and generally designated by the reference numeral 10 will be described.

More specifically, it will be noted that the motorized string tuning apparatus 10 essentially comprises an elongate cylindrical housing 11 housing a conventional motor for effecting torquing of a coaxially extending driven shaft 12. A forwardly mounted on/off switch 11*a* effects actuation and rotation of said shaft 12 in a conventional manner. Axial shaft 12 is secured to cylindrical housing 11 on a forward face 28 thereof by means of a retaining collar 13. Integrally secured to a distal terminal end of shaft 12 is a bifurcate d socket 14 formed with a first and second finger element 15 and 16 respectively for engagement of a peg 18 of a typical musical instrument, such as a guitar, mandolin, or the like. Floor 17 extending between first and second finger elements 15 and 16 limits the axial extent of peg 18 within said socket. Emanating from the other face of housing 11 is a conventional power cord 21 for transmitting and supplying electrical energy to the aforenoted apparatus.

A counter member 20 is positioned at a proximate end of cylindrical housing 11 and positioned for convenient visual inspection. Counter 20 enables a user to keep track of the rotations of bifurcated socket 14 to enable a user thereof to avoid over-torquing of an associated string to overstress same. Should the counter 20 illustrate a relatively large number of turns, it may become apparent to a user that a string has reached its elastic limit and is accordingly approaching the end of its useful life add should accordingly be replaced.

Figure 5:
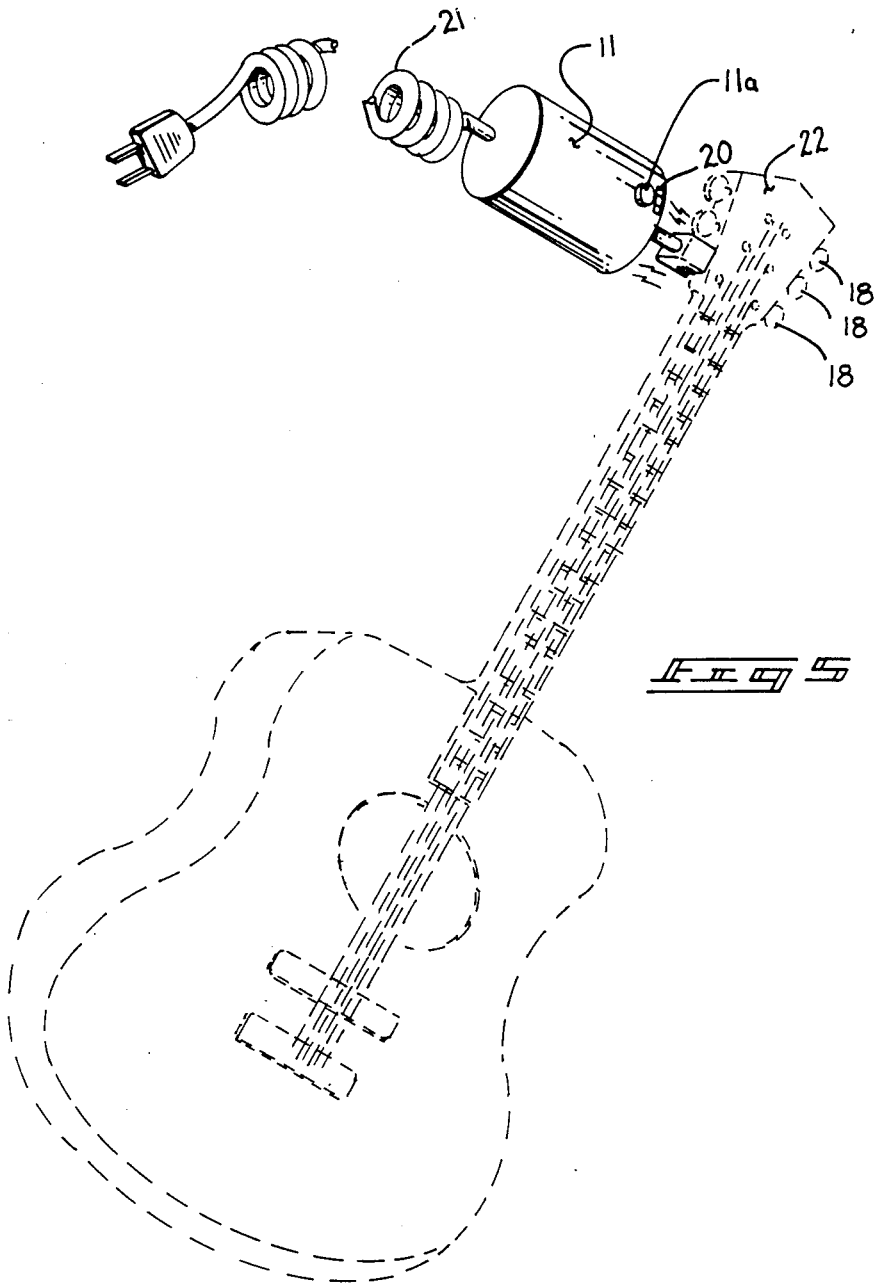
FIG. 5 is an isometric illustration of the instant invention in application to a musical instrument.

In conjunction with the torquing of peg 18, a series of lights 19 are configured and arranged to illuminate the working area of the apparatus and its association with a musical instrument. The lights are electrically associated to switch 11*a* to activate when switch 11*a* is depressed and simultaneously illuminate a work area while bifurcated socket !4 is torquing an associated peg 18. Frequently the working environment of a tuner takes place in dimly lit environments, such as dinner theaters and the like, where limited illumination has proven to be detrimental in enabling a user to visually ascertain which peg of a plurality of pegs, as illustrated in FIG. 5, of an associated instrument such as a guitar is being manipulated and to provide an improved understanding of the proper sequencing of the pegs and the adequate positioning of socket 14 thereon. FIG. 5 accordingly is illustrative of a typical tuning operation where a guitar 22 is being tuned by the instant invention and the elongate axial aligned housing and coextensive shaft enables ready access to the various pegs 18 and further enables improved illuminated viewing of the work area.

As to the manner of usage and operation of the present invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A motorized string tuning apparatus for use in torquing pegs of associated string musical instruments comprising, an elongated cylindrical housing formed with a forward and rear end face, an axial driven shaft extending axially outwardly from within said forward face at one end and formed at said other end with a torquing means for receiving and torquing said peg, a counter positioned on said housing to count revolutions of said torquing means and switch means positioned on said housing to energize an included electrical motor positioned within said housing to rotate said axial shaft and said torquing means in response thereto.

2. A motorized string tuning apparatus as set forth in claim 1 wherein at least one illumination means is positioned on said forward face and activated in response to activation of said switch means to energize said electrical motor.

3. A motorized string tuning apparatus as set forth in claim 1 where in said torquing means comprises a bifurcated socket member formed with parallel spaced finger elements emanating from an adjoining floor portion.

4. A motorized string tuning apparatus as set forth in claim 3 wherein said cylindrical housing, said switch means, said counter, said axial driven shaft, and said torquing means are all axially aligned for enhanced access to said pegs.

* * * * *